US009861878B2

(12) United States Patent
Penna et al.

(10) Patent No.: US 9,861,878 B2
(45) Date of Patent: Jan. 9, 2018

(54) BILLIARD TABLE APPARATUS FOR COMPETITIVE PLAY AT REMOTE LOCATIONS

(76) Inventors: Thomas David Penna, Victor Harbor (AU); Stephen John Grant, Fullarton (AU)

( * ) Notice: Subject to any disclaimer, the term of this patent is extended or adjusted under 35 U.S.C. 154(b) by 443 days.

(21) Appl. No.: 13/139,825

(22) PCT Filed: Dec. 16, 2009

(86) PCT No.: PCT/AU2009/001640
§ 371 (c)(1),
(2), (4) Date: Aug. 10, 2011

(87) PCT Pub. No.: WO2010/068989
PCT Pub. Date: Jun. 24, 2010

(65) Prior Publication Data

US 2011/0294585 A1 Dec. 1, 2011

(30) Foreign Application Priority Data

Dec. 16, 2008 (AU) ..... 2008906432

(51) Int. Cl.
*A63D 15/00* (2006.01)
*A63D 15/20* (2006.01)
(Continued)

(52) U.S. Cl.
CPC ..... *A63D 15/20* (2013.01); *G07F 17/38* (2013.01); *A63D 15/00* (2013.01); *A63D 15/003* (2013.01); *G07C 1/22* (2013.01)

(58) Field of Classification Search
CPC ..... A63D 15/20; A63D 15/00; A63D 15/006; G07F 17/32
(Continued)

(56) References Cited

U.S. PATENT DOCUMENTS 3,448,459 A * 6/1969 Margolis ..... 473/24
4,636,951 A * 1/1987 Harlick ..... 463/25
(Continued)

FOREIGN PATENT DOCUMENTS

CN 103028238 A * 4/2013 ..... A63D 15/00
EP 2271414 B1 * 6/2014 ..... A63D 15/00
(Continued)

OTHER PUBLICATIONS

The New Illustrated Encyclopedia of Billiards, by: Mike Shamos copyright 1993 pp. 136, 252 and 253.*
(Continued)

*Primary Examiner* — Mitra Aryanpour
(74) *Attorney, Agent, or Firm* — Renner Kenner Greive Bobak Taylor & Weber

(57) ABSTRACT

An arrangement adapted to be used with conventional billiard tables for greater utilization, versatility and/or application of said tables, said arrangement including, a multiplicity of billiard tables located at a variety of separate locations, a means to register and allow for communication between a plurality of players, such that said players need not necessarily play upon the same table nor be located at the one location, said players intended to compete against other registered players, or approve upon personal individual skill level, a timer such that competition between players or improvement of personal standings of an individual is based upon timing of pocketing a set of balls or part thereof upon the respective billiard table by said, timer, a means for having time results of the or each player transferred to a central database wherein individual player's times and standings may then be acknowledged.

8 Claims, 7 Drawing Sheets

(51) Int. Cl.
*G07F 17/38* (2006.01)
*G07C 1/22* (2006.01)

(58) Field of Classification Search
USPC ..... 473/1, 4, 23–25, 27
See application file for complete search history.

(56) References Cited

U.S. PATENT DOCUMENTS 4,856,787 A * 8/1989 Itkis ..... 273/237
4,878,664 A * 11/1989 Brookes ..... A63D 15/20 473/23
4,882,676 A * 11/1989 Van De Kop et al. ..... 473/2
4,926,327 A * 5/1990 Sidley ..... 463/13
5,066,008 A * 11/1991 Rivera ..... A63D 15/20 473/23
5,071,121 A * 12/1991 Garret ..... 473/1
5,083,271 A * 1/1992 Thacher et al. ..... 700/92
5,359,510 A * 10/1994 Sabaliauskas ..... 700/91
5,472,194 A * 12/1995 Breeding et al. ..... 463/27
5,593,349 A * 1/1997 Miguel et al. ..... 463/30
5,630,759 A * 5/1997 Lee ..... A63D 15/00 473/23
5,741,183 A * 4/1998 Acres et al. ..... 463/42
5,761,647 A * 6/1998 Boushy ..... 705/7.29
5,772,509 A * 6/1998 Weiss ..... 463/16
5,857,912 A * 1/1999 Freitag et al. ..... 463/42
6,241,608 B1 * 6/2001 Torango ..... 463/27
6,416,408 B2 * 7/2002 Tracy et al. ..... 463/16
6,582,316 B2 * 6/2003 Tompert ..... A63D 15/006 473/1
6,764,410 B2 * 7/2004 Apple et al. ..... 473/70
6,830,513 B1 * 12/2004 Ballard ..... 463/14
6,912,432 B1 * 6/2005 Shea ..... 473/54
7,361,083 B2 * 4/2008 Valero Moreno ..... 473/476
7,384,341 B2 * 6/2008 Martin ..... A63D 15/20 473/27
8,241,136 B2 * 8/2012 Bennett ..... 473/23
8,616,971 B2 * 12/2013 Lundback et al. ..... 473/1
2002/0010032 A1 * 1/2002 Stiteler ..... 473/54
2003/0064807 A1 * 4/2003 Walker et al. ..... 463/42
2005/0192091 A1 * 9/2005 Siewert ..... A63F 5/00 463/31
2006/0063599 A1 * 3/2006 Greenspan ..... 473/1
2006/0183524 A1 * 8/2006 Neff ..... 463/11
2007/0026956 A1 * 2/2007 Pearson ..... 473/1
2008/0182675 A1 * 7/2008 Flores ..... 473/27
2008/0269925 A1 * 10/2008 Lita ..... 473/1
2009/0149262 A1 * 6/2009 Martin et al. ..... 463/43
2009/0215546 A1 * 8/2009 Rogers ..... A63D 15/00 473/1
2009/0270179 A1 * 10/2009 Cyr ..... 463/42
2011/0021256 A1 * 1/2011 Lundback et al. ..... 463/2
2012/0078667 A1 * 3/2012 Denker et al. ..... 705/5
2012/0083342 A1 * 4/2012 Cross et al. ..... 273/371
2013/0012330 A1 * 1/2013 Speed ..... A63D 5/04 473/54
2014/0066217 A1 * 3/2014 Stimac ..... 473/4

FOREIGN PATENT DOCUMENTS

GB 2430895 A * 4/2007 ..... F41J 3/02
KR 101229983 B1 * 2/2013 ..... A63D 15/00
WO WO 9530872 A1 * 11/1995 ..... F41J 3/02
WO WO 2009126982 * 10/2009 ..... A63D 15/00
WO WO 2009126982 A2 * 10/2009 ..... A63D 15/00

OTHER PUBLICATIONS

PoolTimer Tm User Guide—A New Application To Measure And Record Shot Time Intervals In The Pool And Billiard Sports; 2010 Performance Accountability, LLC. http://poolapps.com/wp-content/uploads/2010/02/Timer_User_Guide.pdf.*

* cited by examiner

BILLIARD TABLE APPARATUS FOR COMPETITIVE PLAY AT REMOTE LOCATIONS

TECHNOLOGICAL FIELD

This invention relates for the better utilisation of the inanimate billiard table and more particularly an arrangement for use with a multiplicity of conventional billiard tables in order to increase such table's utilisation, versatility and/or application for a broader range of uses and players than one would expect otherwise from the standard individual billiard table.

BACKGROUND

Throughout this specification the applicant continually refers to terminology such as a billiard table, nonetheless this terminology is not to be interpreted restrictively in any way and simply as a way of describing a table that has a series of pockets or holes along it's peripheral edge to which when a set of balls is placed upon such a table the objective is to pot such balls in the relevant pocket.

Still further while this specification describes an arrangement applicable to billiard tables there is nothing within its scope that could not see it as equally applicable to other games such as Darts, Ten Pin Bowling and so forth.

The arrangement to which this specification relates to is applicable to all kinds of tables to which such games are played upon and include but are not limited to billiards, pool, snooker, 8-ball and the like.

Most members of the public, at least those who have reached their teens and beyond are very familiar with the conventional or traditional billiard table.

The billiard table need not necessarily look all that different from a standard table but it is characterised by its felt cloth on the surface of the table and the various holes or pockets that are placed in symmetry about the edge of the table.

Throughout the ages people of all ages have enjoyed developing a skill and having fun in the task of using a cue to impact upon one ball which then makes contact with another in the hope that this engagement will lead to that later ball being struck ending up in one of the pockets of the table.

While this simple game of potting balls has been enjoyed for many a long year, the fact remains that in this modern day society individuals require slightly more sophistication or challenge in order to improve upon their skills of completing a task or in fact even deriving some type of satisfactional enjoyment from the playing of a game.

While the traditional game of billiards is an appropriate way to pass time, the fact remains that these kinds of tables in many instances now remain unutilized in entertainment locations such as hotels, pubs, pool halls, recreational centres, private residences (games rooms) and the like. People these days are presented with just too many ways in which to utilise their leisure and have their mind invigorated by challenges.

For example the release of the worldwide web into most homes and entertainment locations has meant that many people can play or be involved in very sophisticated electronic games against competitors playing the same game all over the world. Hence while the player may be simply accessing his or her own computer from the backroom of a residential property, they may very well be competing with a player in an internet café on the other side of the globe.

While playing electronic games can stimulate the mind, they do very little to invigorate the body as a whole and also by the very nature of an electronic game, which is often confined to a single screen or monitor, the ability for respective players to physically interact both within the environment about them and within the game itself is particularly limited.

Preferably it would be particularly advantageous if somehow the conventional traditional game of billiards could be improved upon in order to make it more conducive to the modern day requirement of members of the purchasing public who are looking for not only physical adrenaline of playing a game, but also some additional interaction over and above than one would expect from simply two players, playing a conventional game of billiards where one would either pocket a set of balls faster than the other, or alternatively pocket a series of balls to obtain a higher score than the other player.

It is therefore an object of this invention to provide a billiard table or at least an arrangement to work with a billiard table that can ameliorate or overcome some of the short comings referred to above or at least provide members of the public with an arrangement that will be able to improve the utilisation, versatility and all the general application exposure of the conventional billiard table.

Further objects and advantages of the invention will become apparent from the complete reading of the following specification.

SUMMARY OF THE INVENTION

Accordingly in one form of the invention, although this need not be the only nor indeed the broadest form of the invention there is provided an arrangement adapted to be used with conventional billiard tables for greater utilisation, versatility and/or application of said tables, said arrangement including,

- a multiplicity of billiard tables located at a variety of separate locations,
- a means to register and allow for communication between a plurality of players, such that said players need not necessarily play upon the same table nor be located at the one location,
- said players intended to compete against other registered players, or approve upon personal individual skill level,
- a timer such that competition between players or improvement of personal standings of an individual is based upon timing of pocketing a set of balls or part thereof upon the respective billiard table by said timer,
- a means for having time results of the or each player transferred to a central database wherein individual player's times and standings may then be acknowledged.

An advantage of such an arrangement is that for the first time the billiard table and the players that play upon such a table are in communication with another table and another set of players at a separate location.

Advantageously just like in the virtual world, this arrangement has allowed the very traditional or conventional billiard table, renown for its innate characterisation, to join the electronic era of modern day telecommunication.

This arrangement even in it's most simplest form introduced above and to be discussed in its various further preferred embodiments following hereafter, means that players now no longer have to compete with those within their close physical proximity.

As is to be expected when players come together so regularly in the one particular location and physically engage in game playing, familiarization of a particular player's skill or ability are recognised.

What this means is that over time given that each player knows the level of skill or ability of another player reduces some of the excitement or expectation about a particular game.

Either particularly good players would find it uninspiring to play players of lower level and so too conversely players with limited ability would feel intimidated by playing people they know have a greater skill level.

This system creates an environment where players of all skill levels can strive to improve their own personal best performances and can compare their performances against other players around the world.

Advantageous this arrangement is interconnected to create a sporting entertainment concept that will unite people around the world The catch cry 'fast action 8 ball' that applies to the arrangement indicates that players and spectators will be intertwined as skill, precision, and competitive nerve will come into play for players of different skill levels and backgrounds.

Advantageously with the arrangement provided herewith players by registering as part of the system become a part of a complete pool of players from a whole variety of locations.

It is easy foreseeable that this arrangement would allow someone in an outback remote hotel in central Australia to be playing off in a competition against a player from a crowded street bar in New York City. Not only is there the traditional conventional physical excitement of playing a game of pool by employing this arrangement but also advantageously by utilising electrical communication in a virtual sense, players are not only physically engaged within a game but also simultaneously becoming part of a greater personal communication exchange between a player at a separate location.

In preference the timer includes a series of senses located at each of the respective pockets that have been included on the billiard table.

Preferably these senses not only are able to time the interval or period of time it takes for a player to pot a set or part thereof of the balls on a table, it can also do so cumulatively.

Advantageously information sent to central database will not only show the actual time it took for the player to complete the competition requirements of that particular game, but also give a breakdown of the rate at which the balls were being pocketed. For example was there a faster rate for the first series of balls pocketed or did the rate or timing improve after the initial balls were pocketed.

In preference, the arrangement also includes some type of closed circuit television arrangement, or similar technology thereof such that each of the respective tables is under visual observation during competition so that players may not artificially or even unintentionally pocket balls or throw balls into pockets that are not in the spirit of the overall requirements of the game competition.

An advantage of such an arrangement is that there is no requirement for some type of central umpire or guardian at each of the tables. The requirement to have someone viewing each particular game would make the whole process particularly cumbersome and problematic, depending on the integrity of the respective umpire.

Advantageously the arrangement provided for herewith is able to still monitor player behaviour throughout the game to make sure that they are abiding with competition requirements through the use of circuit type television.

Hence if there is some type of dispute or any results need to be verified as the game has been recorded such reviewing and therefore investigation of the timing of the relevant players can then be easily completed.

If the player in outback central Australia is competing with someone in New York City and there is some conjecture about the results that have been derived, advantageously the close circuit TV recording the games at each of the locations can then be investigated in order to determine what the appropriate outcome should be.

As is to be appreciated the circuit TV will also be very useful in those situations where one of the locations could have a billiard table in a residential or a more confined location where an individual player is trying to improve upon his own personal standing but also wishing to compete against other registered players.

There may be the tendency in these isolated locations to accelerate or artificially pocket balls rather than through the use of a cue and the white ball, advantageously if a player is to be registered there will be a requirement as part of the arrangement that the billiard table is monitored or viewed by circuit based television so that any game played which forms part of the competition within the pool of registered players is recorded. This security is to enhance good sportsmanship and 'the spirit of fair game'.

Players will also have the option of downloading the video clip from the central database and keep it as either a memento of their performance or use it as a training aid by examining its contents to improve performance.

The central database will also display top performance clips on its website for member players and the public in general to enjoy. A collection of high performance clips gathered from locations around the world is sure to create a highly entertaining and exhilarating package.

As a person skilled in the art can appreciate there are a variety of timers available.

For example some timers could be simple utilisation of high sensitive digital stopwatches, providing accuracy up until one hundredths of a second.

Nonetheless in various alternative embodiments of this arrangement in some instances timers could be a particular song, in that where the player finishes pocketing a set of balls, the time result is indicated by a particular word within a song.

This timing idea could be further enhanced upon wherein not only is the music playing but there is also a visual film clip accompanying the music with karaoke type subscript appearing on screen showing just how close a player is to particular words in a song and the rate in which he or she is pocketing a respective ball.

Hence rather then seeing a clock being run down or run up, music and words to that particular song act as the timer.

Players can select their own music to inspire their performances. Individual song choices are coded onto registration cards and can be activated when players play registered games.

The skill of a player is enhanced by selecting songs that they continually play to and each move can be synchronised to the beat of the song.

The music also creates an atmosphere at locations where registered games are played. This adds to the excitement of crowd participation as audiences get into the swing of the music and cheer on their favorite players to higher performances.

Audiences will sense when a player is 'on a roll' and a fast time is beckoning. They will become part of the sporting-entertainment concept as they will players on to 'beat the clock' with a fast timed performance.

Games can be played by individuals, either competing in championship competitions or simply to improve their own personal best times.

While the essence of this concept is about speed i.e. potting all of the balls on a table in the quickest possible time, an adaption to the game format, to build endurance into the mix, would be where an individual player or a team of players pot as many balls in a set amount of time. For example ten minutes. Players would need to re rack each set of balls after a set of balls had been pocketed to continue the game until the allotted time had expired.

Added excitement to games can occur when teams of multiple players unite to perform. Where by each player has a single shot then his or her team mate follows with their shot. Their collective aim is to work together to pot all of the balls in the fastest possible time. For example teams could be made up of 2, 3 or 4 players rotating shots for a collective outcome.

In preference, the arrangement has the billiard table in communication with a touch or push button activatable screen.

In one embodiment of this invention this touch screen or push button activatable screen is in a separate console which would stand in reasonable close proximity to the billiard table.

In other embodiments the console could in fact be integral with the billiard table.

Preferably the console would be equipped to broadcast music and to show moving images, video's and the like.

An advantage of such an arrangement is that while in most places of entertainment the music box, commonly referred to as a jukebox and the billiard table remain separate and unrelated to each other, in this arrangement they compliment each other.

Advantageously in this arrangement the jukebox and the billiard table are brought together to work in synergy to utilise both structures more efficiently so that they have greater utilisation by patrons.

In preference, the arrangement includes an essential administration point which is in communication electronically with each of the locations to which the respective billiard tables are located.

Preferably access to the central administration location can be made on the internet by logging on to a provided website.

In a preferred form of the invention, players would register online at the provided website and pay preferably an annual fee which will then give access to them to a members card allowing them to play at any registered location to which the billiard tables have been located.

Once the player has been registered he or she will then be able to interact with the console which is provided for at each of the locations to which the billiard table may be accessed.

Nonetheless the person skilled in the art will appreciate there will be a variety of ways in which players can register and in some instances and in some embodiments of the invention no player card per se will be required, players can simply log on to a website, provide their details, pay the necessary fee and then be issued with a user ID and related password.

Advantageously this particular registered player can then visit any location to which the arrangement has been installed and compete at that particular location by providing their ID and password on the relevant console.

Preferably competition as introduced above is based on timing but it may lead to a championship that could be introduced at either regional, state, national and even global levels.

In preference players not only pay a fee in order to become registered players they also pay for each game they wish to compete.

In one embodiment the payment paid by the respective player to compete sees part of the paid amount being transferred to a pool which would then form part of a prize pool for the respective championships per se.

Advantageously what this means is that players can not only spend their money in playing a great game of billiards and interacting or competing with players from all over the world, they also present to themselves the opportunity of winning titles and championships and thereby getting access to prize money and financial reward.

Preferably also in some embodiments of the arrangement when payment is made by a player part of that payment instead of going to a prize pool which would be then distributed to various winners in championships and titles, part of the funds are transferred to a general lottery which would then regularly be drawn randomly to any particular registered player.

Advantageously under this arrangement for those players whose skill level may not be as high or is limited slightly than other registered player, they still have the opportunity of being able to get a financial return from playing the game.

Hence when one plays a conventional poker machine all they are simply doing is putting their money into a slot to see if they are a lottery winner.

Advantageously under this particular arrangement there is still the scope for a lottery type winning return to players, but advantageously the respective players also get the opportunity of playing an exciting game of billiards competing with registered players from all over the world.

Teams and individuals could represent their countries and have option to play with ball sets that are in their country's colours with their country's flag also inscribed.

In preference, the arrangement is such that the game of billiards would include cue ball's having three or more white cue balls to keep the pace of the game at an accelerated level so that players can quickly retrieve a cue ball from the tray when the cue ball on the table is scratched rather then waiting for the cue ball to return through the traditional return mechanism.

In preference, the central administration body responsible for communicating with each of the locations and the registered players also provides periodic newsletters and the like in order to keep each respective player aware of their standings, games and features available through the arrangement.

The newsletter would also collect stories from players around the world and serve as a central communication connection creating a club-like involvement for players, arrangement associates and the general public.

The concept could also be adapted to TV programming as a sporting-entertainment concept that creates programmes from actual games played from different locations around the world and furthering the stories and profiles of the players, locations and people involved.

As the person skilled in the art would appreciate such websites can also promote and explain championships and the various associated competition requirements as to the game to be played, player's ability and eligibility.

As to be expected such a central database and the accessible website can also display various national and world player rankings and also display sponsorship pages and the like, and can even provide an outlet for members to also advertise their own relative business and interest.

Nonetheless as can be seen one of the real focuses of the arrangement is the interaction or the virtual community that has been created from something which as introduced above down through the ages has been anything but part of the electronic modern media, that being the conventional billiard table.

In a further embodiment of this invention the main focus will be to provide the concept which can combine the modern technology of the electronic media particularly the Internet and so forth and adapt it to traditional physical games such as the playing of billiards, and even to certain extents darts, ten pin bowling and so forth wherein the link between the traditional game such as billiards through this modern means of telecommunication can link to other such locations where billiards and so forth are played to establish a related network of players who can interengage.

In one embodiment of the game to this further embodiment introduced in the preceding paragraph the traditional use of the billiard table will involve the playing or potting of balls on a billiard table as quickly as possible.

Preferably players can compete to get the lowest time against opponents from all over the world which is made possible by the linking together of the various locations where games are being played through the established electronic link such as through the internet and so forth.

As can be appreciated it is played on real pool tables, and the game provides the necessary hardware and software to accurately time how long it takes to pot all balls, and provides a video, audio and data connection between venues and to a central server where information is stored.

Advantageously what we have is a fun physical activity that can be enjoyed by people of all ages and skill levels, and unlike conventionally when people would meet and play against others such a game of billiards or so forth in the one location, through this use of modern-day telecommunications a network is established which will link a variety of locations that contain the pool tables where games are played for interaction between the respective players.

For the purpose of simplicity from hereonafter discussion will be made with respect to the game played on a conventional billiard or pool table referred to as 8-Shot.

The 8-Shot system as a whole include both the hardware and software associated with the system that will be discussed hereonafter by way of an example of how this invention can be applied.

Nonetheless as discussed preceding this further description is provided simply as a way of showing how the invention could be presented in a complete working example and many of the features or described hereafter will not be essential to the invention that has been described herewith and also referred to in the preferred embodiments shown by way of the illustrations also to be discussed shortly.

In preference a management control unit which would establish a web interface and interaction for telecommunication between respective venue locations would be installed above the conventional billiard table at each venue to which the 8-Shot game is being played.

This management control unit or system would allow communication of data and streaming video and audio between each of the other venues, for example via the internet and so forth. In some embodiments capabilities can be provided that would also allow other parties to be able to view the streaming video of a game.

For example audiences from other locations may be interested in knowing who at the moment is playing against each other and so forth and so it is possible to view distantly as a third party via the internet and so forth various games taking place on the conventional pool tables at the various locations across the globe.

Preferably during a game at least two locations or venues where 8-Shot games are taking place on conventional billiard tables or pool tables are paired together, so effectively we have one player acting as an opponent to another or a group of potential players. Each player or location communicates with each other via audio voice (voice over IP), view video of each others games progress, and the start of play is synchronised between the or each of the venues to provide extra excitement of racing the or each other player to clear the table in the fastest time possible.

Preferably the video input and output functions to capture from up to two sources. Preferably a table camera that views the playing area of the pool table, and a room camera that views the table plus the players and the audience. A second camera may or not be available at each installation.

Preferably the table camera is used to monitor the presence of the amount of balls on the table still to be potted, which allows the management and control unit which is located above each of the tables to time the game. When all the balls are potted, including the cue ball, and the entire playing area is visible, for example the participants have moved away from the table the game ends.

A video stream, comprising inputs from the room camera, table camera or a composite of both is able to be compressed and sent via the internet to each or the other opponents which have been paired in this particular game through the use of the management control system.

As is to be expected not only is the information transferred between the relevant locations in real time the management control system will also have a main central server which will allow storage of the information so that it will be available for subsequent viewing at a later date from the relevant website and so forth.

This is particularly advantage in two folds not the least that in the real time exchange means that while the game is taking place in at least two separate locations away from one another, the participants, players and the audience in both locations are very much combined into the one location albeit physically they are still at a distance.

Secondly by being able to not only have real time exchange between locations but also the ability to store the information that is being filmed at a central server for later use, means that players and so forth can review the games played in order to improve upon their own skills and to develop an appreciation of the type of environment and the like that is expected or created during the playing of a game.

The management control system which includes as introduced above, terminals or consoles preferably above each table also receives video stream, game time and other data from the or each of the other opponent players which once again can be viewed in real time or reviewed at a later date.

Preferably a screen mounted at the or each of the venues can be configured to display either the local video stream, the or each of the opponent players' video stream or both in a split screen arrangement.

In some embodiments the venue screen may also display player information, advertising, instructions for the use of the system as when required.

As to be expected the audio input and output could function to capture ambient noise around the table and can be compressed for transmission to the or each of the opponent players' location prior, during or post game time.

Preferably inbuilt speakers play the audio from the or each of the opponent's venue and the players can select audio file from a list of tunes that they have previously uploaded to the management control system, such as their favorite time so that when selected the tune is downloaded and starts playing when the game commences.

Preferably the user interface functions to provide a means of interacting with players, venue operators and system administrators and preferably primary user inputs are through contact-less identification and hand movement/placement within view of the table camera. The system administrator, secondary interfaces are provided, both remotely via the internet, and locally via keyboard and mouse connections behind a removable panel.

Feedback to the user is via the venue screen, audio, and/or via projecting images onto the table surface. The latter method is used to provide virtual buttons that can push by positioning of the hand above the button. The table camera is used to monitor hand positions. This allows all interaction with the game to be contactless.

In some embodiments of the invention all the relevant user interfaces can also employ the latest touch screens capabilities the kinds now one associates with the IPhone and so forth.

As with the traditional lighting fixture used that hangs above the conventional billiard table, the consol of the management control system would also be mounted to the ceiling above the table. The unit will contain all the physical components except cabling and the room camera. As is to be expected a variety of information can be displayed on the monitors whether they be part of the actual unit itself which hangs above the table or separate screens and monitors placed around or within the locations to which the games are being played at these separate locations all linked together through electronic communication.

In one embodiment the management control system unit that sits above the table could in fact display out an image of options onto the table itself to which the user then would select one of those options. The user interface may employ simple icons and graphics to minimise the use of language and therefore this means that the unit itself could be installed in non-English speaking countries to minimise the amount of modifications required.

Hence it is the unit that hangs above the conventional table that projects out an image onto the table producing a series of icons which when touched or interacted with by the user enables the management control unit to decide the required functionality now needed to carry out a particular task such as commencing a game and so forth.

During a game against another player somewhere else in the world, video data is saved by that particular management unit, which assigns the video file to a unique identifier to be stored in the central database.

At a later time, the participant can log into the server via website interface, view their statistics and retrieve the video of a previous game.

The region controllers act as cashiers for information being sent from region to region and provide redundancy.

The central database will be regularly backed up and also mirrored on a separate server, providing secondary connection to the information if the primary connection is interrupted due to the internet problems or outage.

Game requirements for the most part will require identification of a registered participant by displaying their details on the screen. The management control unit hanging above the conventional table will display participant selected game options to the participant. This should be done by projecting the options onto the table surface as introduced above.

Preferably the player will have a variety of options wherein they could simply select to race against the clock, compete against a random opponent and so forth.

The user can also decide whether or not they wish to be in fact viewed in real time or reviewed by others independently at a later date.

In order to describe the invention now in greater detail a series of preferred embodiments will be presented with the assistance of the following illustrations and accompanying text.

FIG. 2 shows preferred embodiment of the invention which includes the independent console which provides virtual interaction between players, the administration main frame and if required real time access to other locations to which the arrangement is provided for.

Figure 5A:
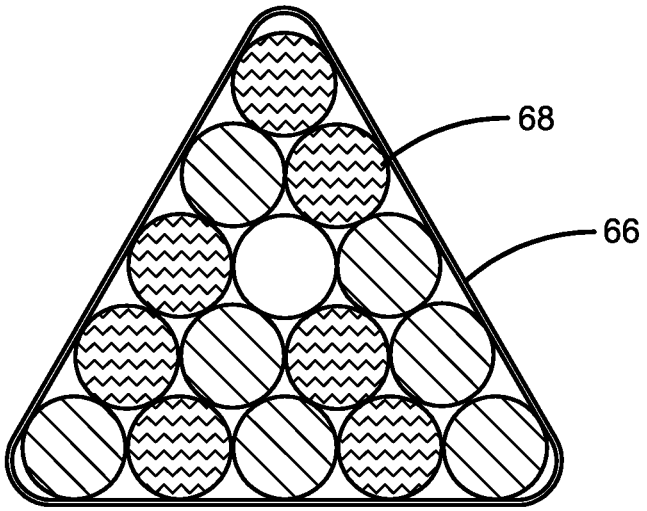
Figure 5B:
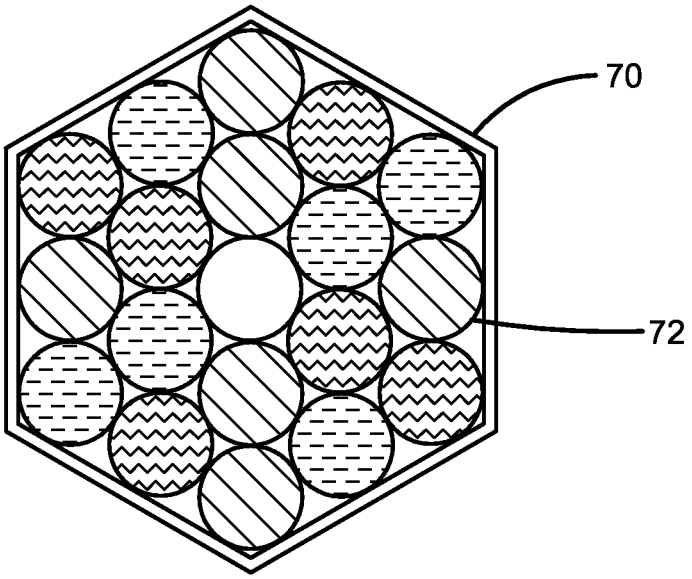
Figure 5C:
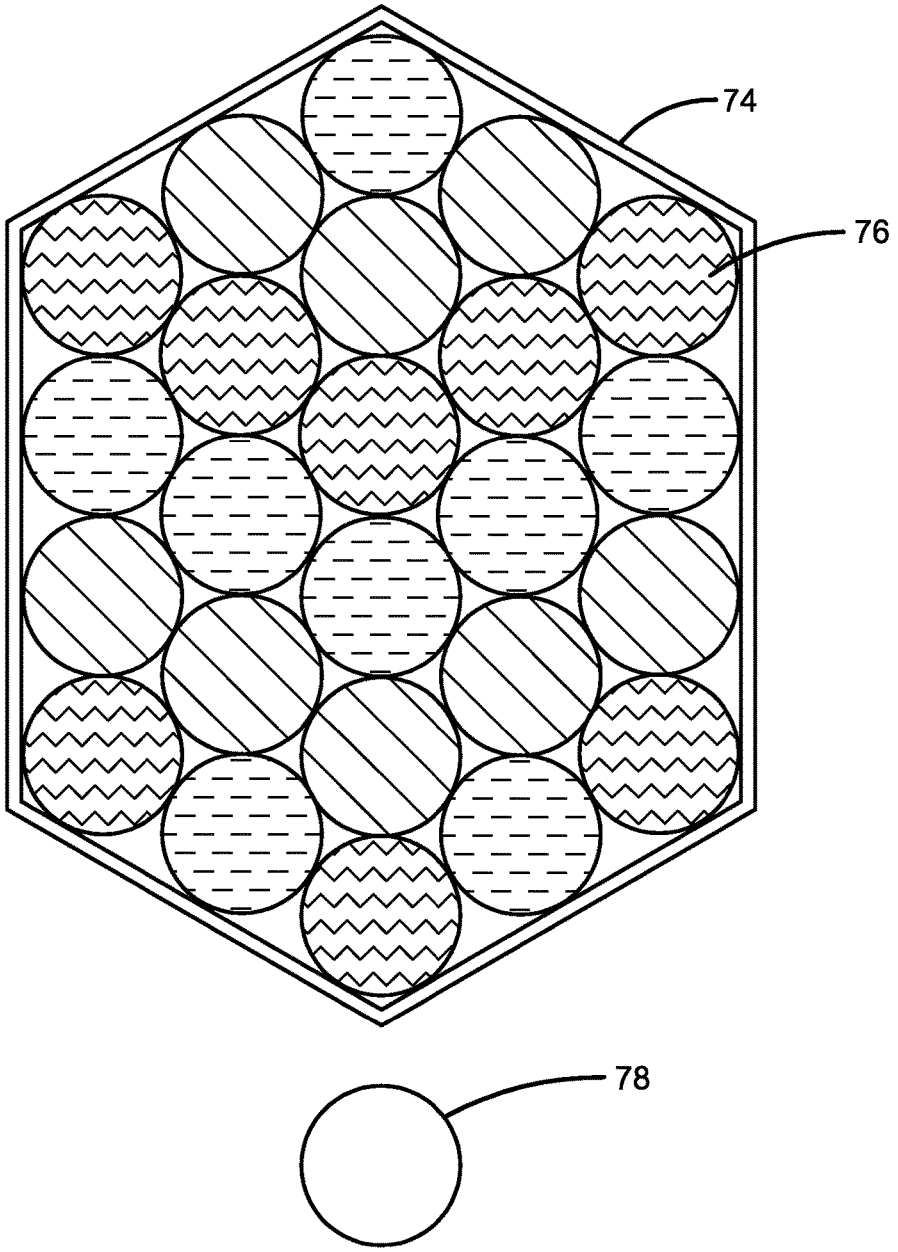

FIGS. 5*a*, 5*b* and 5*c* show a variety of sets of balls that can be used with the arrangement.

Figure 6:
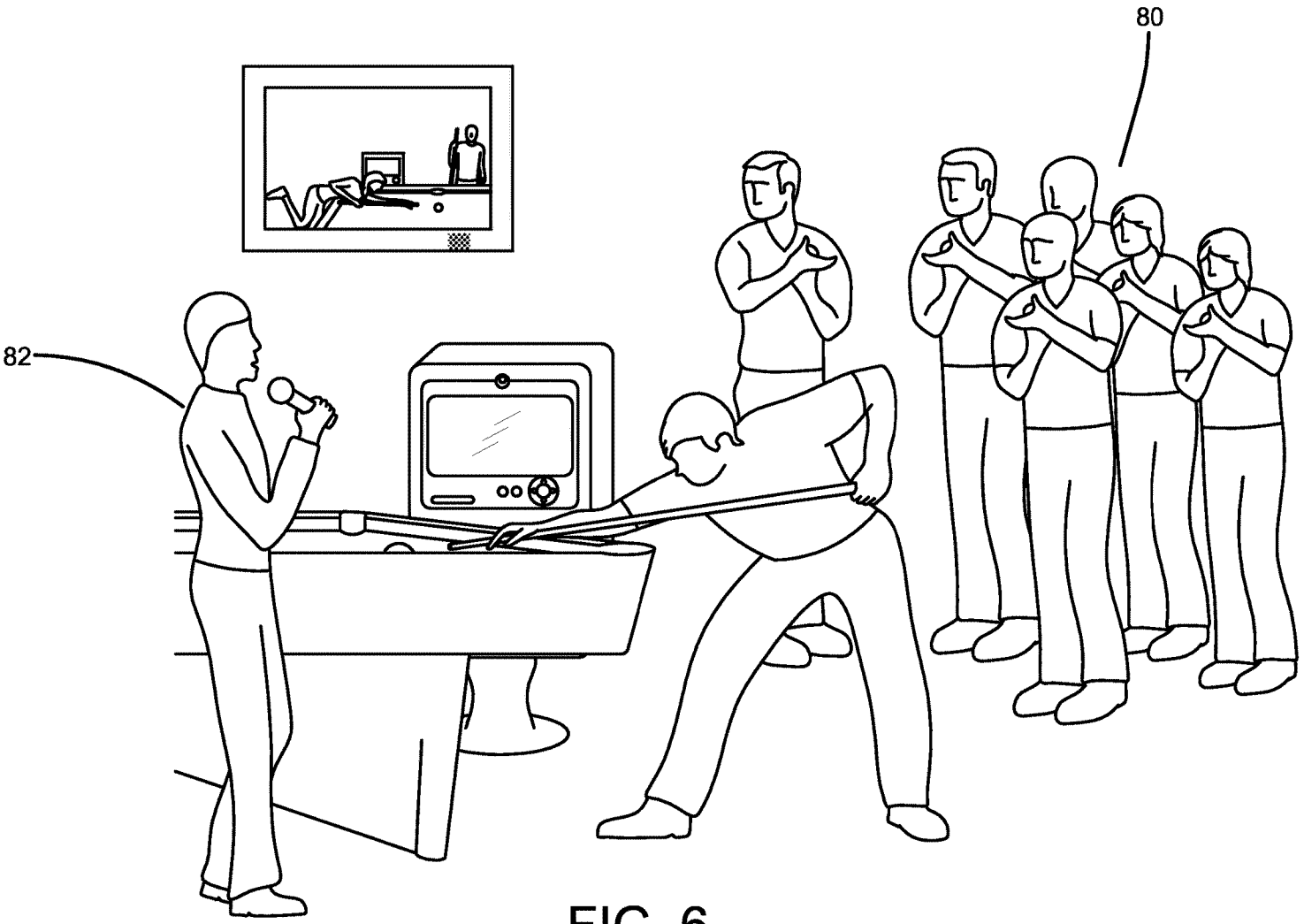

FIG. 6 is a schematic of a cheering crowd in background with player on table and a compare with hand held microphone spurring on the player.

Referring to the drawings now in greater detail where there is provided an arrangement 10 of which allows a conventional billiard table 13, 14 to be placed at separate locations but to be interactively connected through a central administration database, so that the players 20, 22 and players 30, 32 at separate physical locations are interacting with each other in a competitive environment either for fun and/or both championship purposes.

The billiard table includes a cloth felt cover 14 and respective pockets 18 that run a long the peripheral edge of the table 12.

While the billiard tables 13, 14 in some part are conventional in nature, in the preferred embodiment they are purposely provided in order to have inherently adapted within those various features that make the arrangement to be discussed in greater detail below work more efficiently.

For example it would be expected that the billiard tables include timing sensors and the like such that the period of time in which the set of balls 16 (being 15 coloured balls and 1 cue ball) or a part thereof can be pocketed from the table by the respective players.

For some embodiments all championship competitions would be played with a set of 19 coloured balls and 1 cue ball. The extra four balls add to the challenge for top players who could pot the standard 15 balls in a very short period of time.

Tables would be fitted with both a 15 ball and a 19 ball set of balls. Players will have the option of playing a standard game or practice for championship competitions.

24 ball sets could also be available to advanced players looking to further test their endurance and skills.

Figure 1:
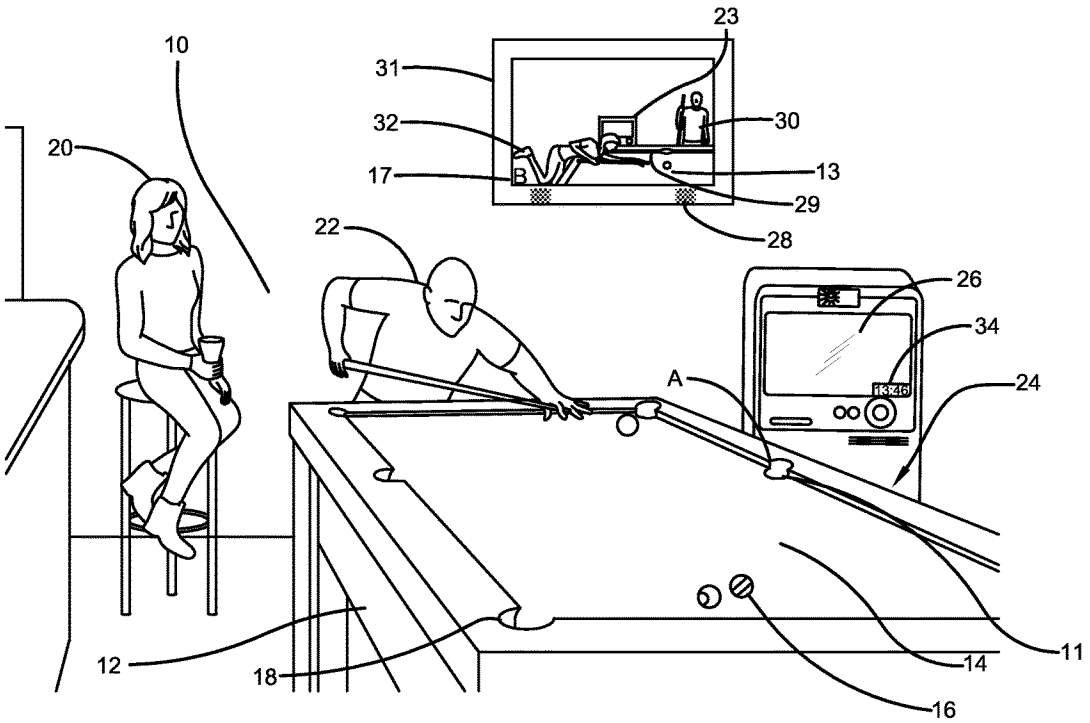
FIG. 1 is a schematic representation of the arrangement in a preferred embodiment of this invention.

As can be visualised from the schematic in FIG. 1 the billiard table 13, 14 at the separate locations also has in close proximity consoles 23 and 24 that act as a gateway to interconnect the separate locations into the one virtual billiard world environment.

While the registration procedure of the respective players is essential to the invention, the means in which registration takes place is not important, but what can be envisaged from FIG. 1 is that players location A shown as 11 and location B shown as 17 in the illustration interact with the respective console's 23 and 24.

Whether the players access the console through a registration card or from an issued identification and can type password is irrelevant to the general scope and importance of the invention, the point remains that these players through the port hole provided for by the respective consoles 23 and 24 are now communicating with players at a separate location so that all players now upon and form part of one particular pool of players all sharing the same interest to play the game of billiards and to compete either between themselves or even individually to improve their timing.

In FIG. 1 location B is visually viewable at location A by virtue of the television screen 31 mounted on the wall at location 11.

The console 24 as been discussed in greater detail in connection with FIG. 2 as a touch screen 26 as well as a timer detailer 34.

In order to stop any players inadvertently circumventing any of the timing arrangements in order to record the amount of time required to play the game the close circuit television 36 is also installed and included as part of the arrangement at location A and B respectively.

Figure 2:
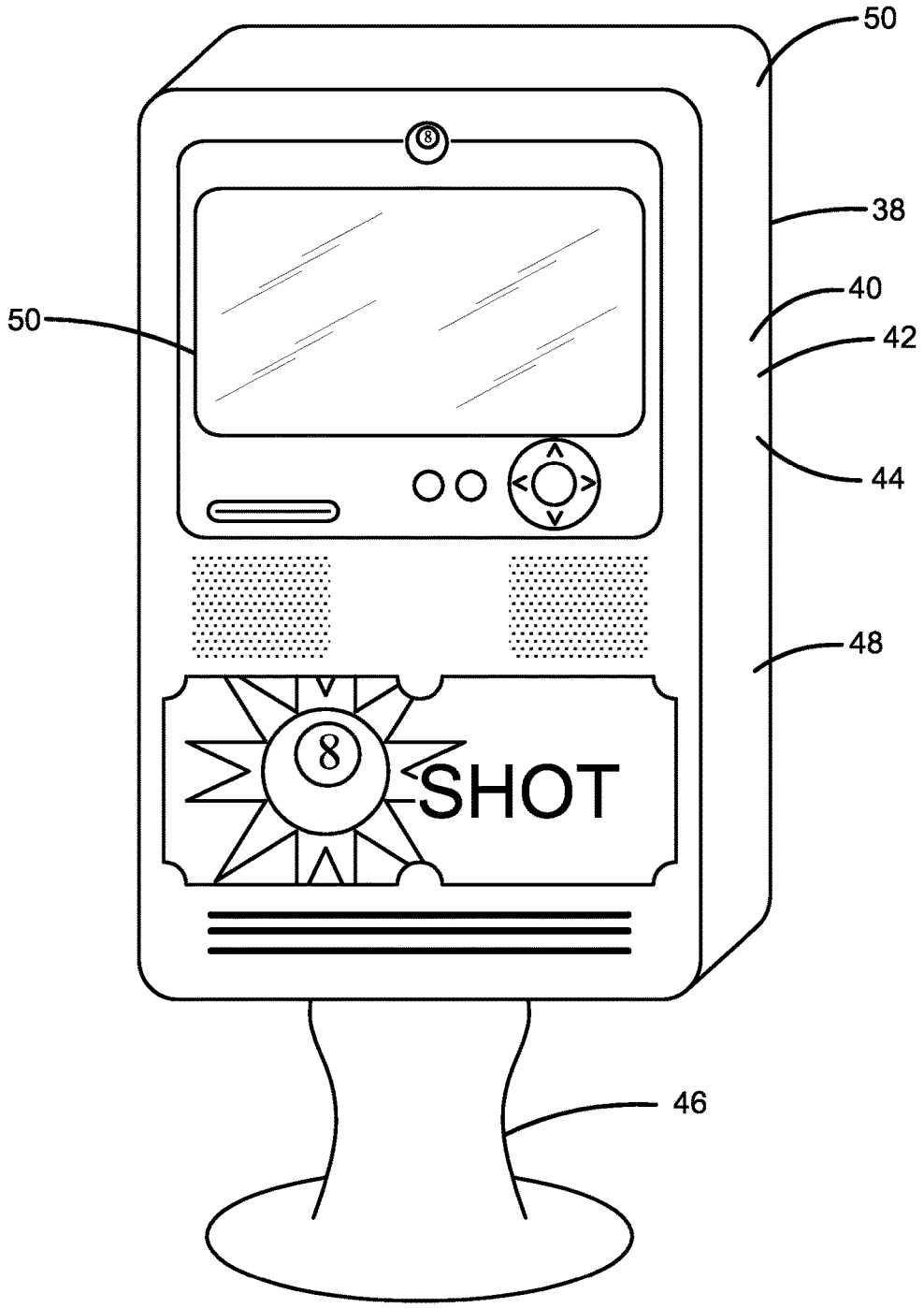

Referring to FIG. 2 the console 38 has various touch screen options shown generally as 40, 42 and 44 which can provide a variety of accessible information as to the game options, locations in which competitions can take place, and virtually any other information about the entire set up arrangement for players to partake in the process.

In some embodiments the console will also allow players to register directly as there will be wireless Internet access from the console directly to central administration base responsible for interconnecting each of the respective locations.

Shown generally as 48 there is a speaker but again the person skilled in the art would appreciate that the console itself could in fact perform just as many functions as one would expect from a traditional juke box and hence not only is there the bringing together of the billiard game concept in the global community environment but also the added excitement and adrenalin one associates with music when involved in physical activity such as playing the game of billiards.

Hence in some preferred embodiments the console which provides that gateway to link all the respective players into the registered pool can also double up as being a jukebox.

In some instances tables could be fitted with speakers. A pulsating table with speakers situated around it may add extra vibrancy to performances.

Figure 3:
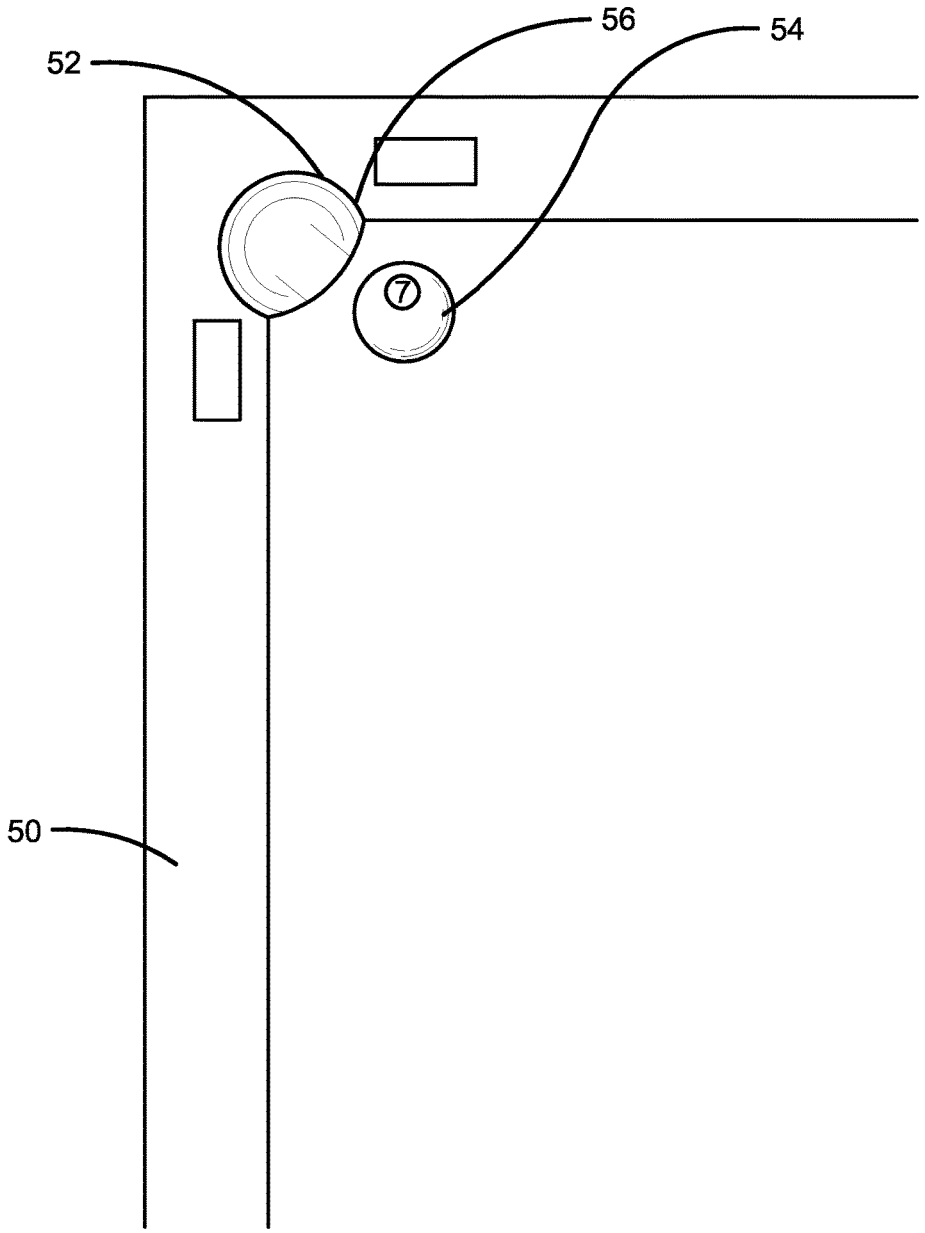
FIG. 3 shows a preferred embodiment where the sensor includes sensing mounts on the respective pockets of the billiard table in order to time the amount of time elapsed in pocketing a set of balls or part thereof as part of the overall arrangement.

FIG. 3 shows again schematically just one of literally scores of embodiments with respect to how one might record timing features as balls are being pocketed during the game.

In this embodiment each pocket 52 includes sensors 56 which are able to recognise a ball 54 being potted on the table 50.

Figure 4:
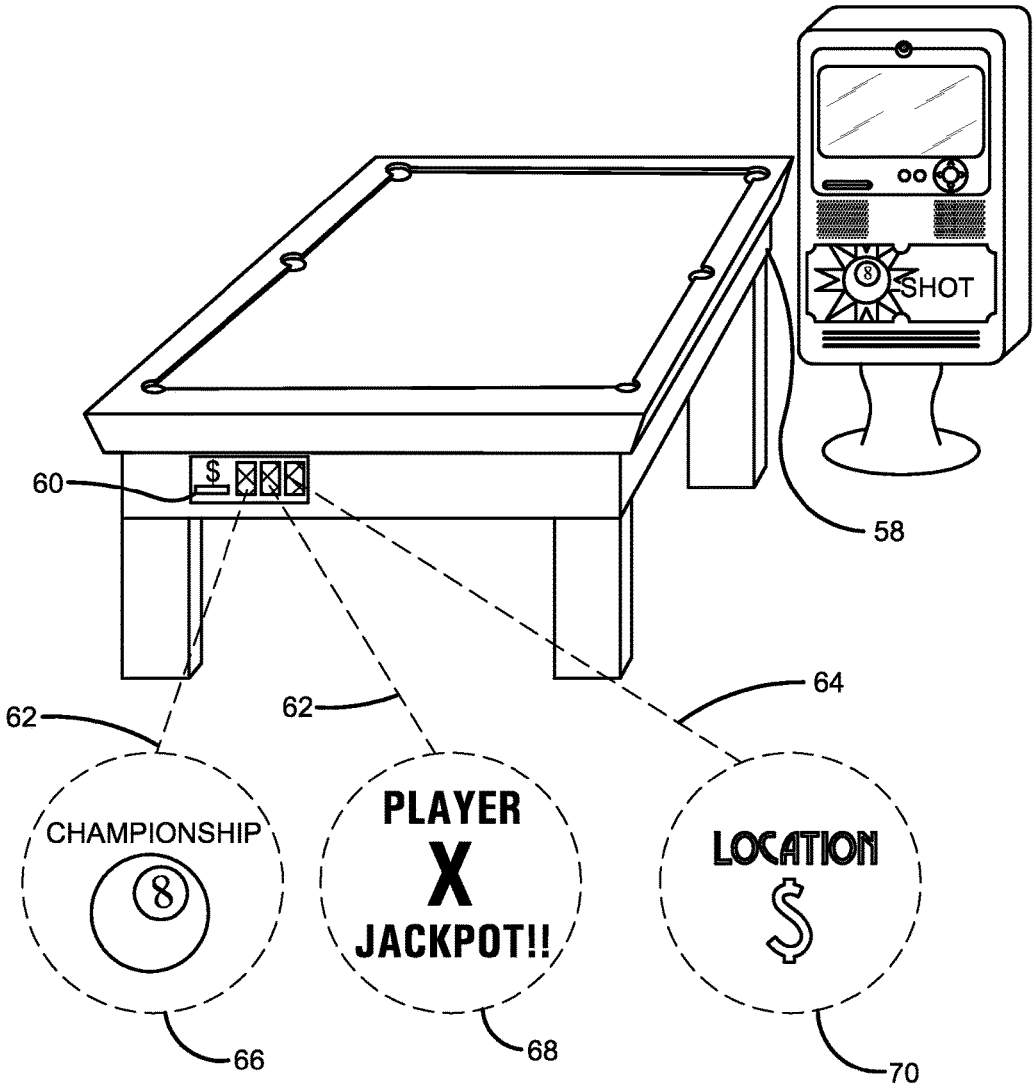
FIG. 4 is a schematic representation showing some of the features of the arrangement but most particularly focusing on the aspect of the payment means when a player accesses the billiard table to commence competition.

The same to do with FIG. 4 again it just represents one option or preferred embodiment of the invention which should not be considered the only nor indeed the broadest form of the invention.

In this particular embodiment it focuses more on the aspect of how when a player plays a game that money provided for can be separated into various pools or funds such as for example part of the payment can go to a championship pool 62 whereby a player could win a championship 66 or alternatively players funds could go to a lottery based funding 62 where a player could receive a jackpot or the like or alternatively even part of the payment 64 can go to the location to where the table has been installed.

FIG. 5*a* shows a standard triangle 66 of a set of 15 balls shown as 68. FIG. 5*b* shows a hexagonal 70 with a set of 19 balls shown as 72. FIG. 5*c* shows a bracket 74 containing a set of 24 balls shown as 76 that could also be available for advanced players. In this embodiment the cue ball 78 sits outside the bracket as shown.

As discussed above players representing their country in competitions could opt to play with balls with their country's colours and flag inscribed. Thus adding a patriotic feel to games.

FIG. 6 is a schematic of a cheering crowd 80 in background with player on table and a compare 82 with hand held microphone spurring on the player.

As introduced above the advantages of splitting the amount of money paid for playing the game means that players can be involved in championships, win a lottery but also those places funding the table also receive a greater return as the game encourages more people the playing on the table and therefore their returns from having that particular table in their premises utilising the arrangement will give them a greater return.

Advantageously also to the location where the table is installed as it will have a greater ability to draw people in to use the table and at the same time they can also then be enjoying other services, such as food and drinks provided for by the location as the game of this modern day billiards unfolds.

The location can partake in communications and associated activities of a sporting and entertainment concept. A concept that has the potential to reach and unite people from around the world.

The invention claimed is:

1. A billiard table apparatus including:

a first billiard table having a plurality of pockets and located at a first location;

a second billiard table having a plurality of pockets and located at a separate physical location;

means for registering a plurality of players at said first location and said second location to thereby define registered players:

means for providing real time audio and video communication to provide audio and visual display of a billiard game between a registered player playing on said first billiard table at said first location and a registered player playing on said second billiard table at said second location, such that the a registered player at said first location and a registered player at said second location may can communicate with each other via audio voice and view video;

a sensor located at each respective pocket of each plurality of pockets of said first and second billiard tables, said sensors sensing when a ball is pocketed in a respective pocket, and said sensors being in communication with a central server to transmit to said central server time results relating to pocketing of balls on the first billiard table by the registered player at said first location and pocketing of balls on the second billiard table by the registered player at said second location such that individual player's times and standings are then accessible.

2. The arrangement of claim 1 further including a camera arrangement at each location such that each playing surface of each of the respective first billiard table and second billiard table is under visual observation during competition so that players may not artificially or even unintentionally pocket balls or throw balls into pockets that are not intended within the spirit of the overall requirements of the game competition.

3. The arrangement of claim 2, including a further camera arrangement at each location adapted to view surroundings of the first billiard table and the second billiard table including the players or the audience or both.

4. The arrangement of claim 1, wherein the means for providing real time audio and video communication between the registered plurality of players includes an overhead control unit above each of the first billiard table and second billiard table, wherein the overhead control unit is adapted to project icons onto the respective first billiard table and second billiard table to which the players of the registered plurality of players can then select particular options therefrom.

5. The arrangement of claim 4, wherein the players of the registered plurality of players can register online at a provided website and pay a fee allowing access to the location.

6. The arrangement of claim 1, wherein the time results transmitted to the central server relating to pocketing of balls on the first billiard table by the registered player at said first location and pocketing of balls on the second billiard table by the registered player at said second location include the interval or period of time taken to pot a set or part thereof of balls on the first billiard table and the second billiard table and the interval of time cumulatively for each ball that is being pocketed on the respective first billiard table and second billiard table.

7. The arrangement of claim 1 further comprising a clock display runnable down or up.

8. The arrangement of claim 1 wherein the timer includes music and words to a song, wherein the song is selectable by the players of the registered plurality of players.

* * * * *